US008847725B2

(12) United States Patent
Buettner

(10) Patent No.: US 8,847,725 B2
(45) Date of Patent: Sep. 30, 2014

(54) TEMPERATURE-DEPENDENT SWITCH WITH A CURRENT TRANSFER MEMBER

(75) Inventor: Lutz Buettner, Sondershausen (DE)

(73) Assignee: Thermik Geraetebau GmbH, Sondershausen (DE)

( * ) Notice: Subject to any disclaimer, the term of this patent is extended or adjusted under 35 U.S.C. 154(b) by 139 days.

(21) Appl. No.: 13/457,681

(22) Filed: Apr. 27, 2012

(65) Prior Publication Data

US 2012/0286923 A1 Nov. 15, 2012

(30) Foreign Application Priority Data

May 12, 2011 (DE) ..... 10 2011 101 862

(51) Int. Cl.
*H01H 37/54* (2006.01)
*H01H 37/00* (2006.01)
*H01H 37/64* (2006.01)

(52) U.S. Cl.
CPC ..... *H01H 37/5427* (2013.01); *H01H 37/64* (2013.01); *H01H 37/54* (2013.01)
USPC ..... 337/365; 337/298; 337/342; 337/343

(58) Field of Classification Search
CPC .... H01H 37/5427; H01H 37/54; H01H 37/64
USPC ..... 337/298, 365, 342, 343
See application file for complete search history.

(56) References Cited

U.S. PATENT DOCUMENTS 2,543,040 A * 2/1951 Mertler ..... 337/86
2,636,098 A * 4/1953 Cataldo ..... 337/89
2,707,738 A * 5/1955 Weissheimer et al. ..... 337/368
2,753,421 A * 7/1956 Mertler ..... 337/347
2,861,151 A * 11/1958 Moore ..... 337/343
3,768,057 A * 10/1973 Sekira et al. ..... 337/349
4,555,686 A * 11/1985 Pejouhy et al. ..... 337/102
4,866,408 A * 9/1989 Petraitis et al. ..... 337/104
5,212,465 A * 5/1993 Mizutani et al. ..... 337/368
5,515,229 A * 5/1996 Takeda ..... 361/105
5,973,587 A * 10/1999 Hofsass ..... 337/377
6,100,784 A * 8/2000 Hofsass ..... 337/343
6,249,211 B1 * 6/2001 Hofsaess ..... 337/377

(Continued)

FOREIGN PATENT DOCUMENTS

DE 30 08 089 C2 9/1981
DE 198 27 113 C2 11/2001
DE 202013101153 U1 * 5/2013 ..... H01H 37/64

(Continued)

*Primary Examiner* — Anatoly Vortman
(74) *Attorney, Agent, or Firm* — Harness, Dickey & Pierce, P.L.C.

(57) ABSTRACT

A temperature-dependent switch comprising a temperature-dependent switching mechanism having a snap-action disc, a housing having a lower part and an upper part which accommodates the switching mechanism, at least two stationary contacts provided on the inner surface of the upper part, each of which is connected to an outer connection, and a current transfer member arranged on the snap-action disc that is moved by said snap-action disc. The snap-action disc presses the current transfer member, in a temperature-dependent manner, against the two stationary contacts which serve as bearing areas for the current transfer member. A third bearing area for the current transfer member is provided on the inner surface. The current transfer member is an approximately round contact plate having on its surface facing the stationary contacts, a contact area closed in a circumferential direction around an axis of symmetry of the switch.

11 Claims, 5 Drawing Sheets

(56) References Cited

U.S. PATENT DOCUMENTS

| | | | | |
|---|---|---|---|---|
| 6,836,205 | B2 * | 12/2004 | Scott et al. | 337/3 |
| 6,891,464 | B2 * | 5/2005 | Scott et al. | 337/343 |
| 7,298,239 | B2 * | 11/2007 | Yamada | 337/107 |
| 2002/0019178 | A1 * | 2/2002 | Fukuda | 439/761 |
| 2003/0102954 | A1 * | 6/2003 | Herrick | 337/102 |

FOREIGN PATENT DOCUMENTS

| | | | |
|---|---|---|---|
| EP | 2 038 905 | B1 | 3/2009 |
| WO | WO2008/006385 | A1 | 1/2008 |

* cited by examiner

TEMPERATURE-DEPENDENT SWITCH WITH A CURRENT TRANSFER MEMBER

This application claims priority to German patent application DE 10 2011 101 862, filed May 12, 2011, which is incorporated herein by reference.

BACKGROUND OF THE INVENTION

The present invention relates to a temperature-dependent switch including a temperature-dependent switching mechanism comprising a snap-action disc, a housing which accommodates the switching mechanism and has a lower part and an upper part, two stationary contacts which are provided on an inner surface of the upper part, each stationary contact being connected to an associated outer connection, and also comprising a current transfer member which is arranged on the snap-action disc and can be moved by said snap-action disc, the snap-action disc pressing the current transfer member, in a temperature-dependent manner, against the two stationary contacts which serve as bearing areas for the current transfer member.

A switch of this kind is known from DE 198 27 113 C2.

The known switch comprises a housing with a cup-like lower part into which a temperature-dependent switching mechanism is inserted. The lower part is closed off by an upper part which is held on the lower part by the raised edge of the lower part. The lower part can be produced from metal or an insulating material, while the upper part is composed of insulating material or a PTC thermistor material.

Two contact rivets are situated in the upper part, the inner heads of said contact rivets serving as stationary contacts for the switching mechanism. The contact rivets project outwards though the upper part and turn into outer heads which serve as the outer connection of the known switch. Connection wires can be soldered directly onto these outer heads, it also being known to hold contact brackets with the outer heads, connection wires being soldered or crimped onto the said contact brackets.

The switching mechanism carries a current transfer member in the form of a contact plate, two mating contacts which are connected to one another being arranged on the upper surface of the said current transfer member and being brought into contact with the two stationary contacts depending on temperature, thereby electrically connecting the stationary contacts to one another. In this case, the stationary contacts serve as bearing areas for the contact plate.

The temperature-dependent switching mechanism comprises a bimetallic snap-action disc and also a snap-action spring washer, a pin which is fitted with the contact plate passing through the centres of the said bimetallic snap-action disc and snap-action spring washer. The snap-action spring washer is constrained circumferentially in the housing, while the bimetallic snap-action disc is supported on a shoulder of the lower part or on the edge of the snap-action spring washer depending on the temperature and, thereby, either enabling abutment of the contact plate at the two stationary contacts, or else lifting off the contact plate from the stationary contacts, with the result that the electrical connection between the outer connections is interrupted.

This temperature-dependent switch is used, in a known manner, to protect electrical appliances from overheating. For this purpose, the switch is connected electrically in series with the appliance to be protected and is arranged mechanically on the appliance such that it is thermally connected to the said appliance.

Below the response temperature of the bimetallic snap-action disc, the contact plate makes contact with the two stationary contacts, and therefore the electrical circuit is closed and the appliance to be protected is supplied with power via the switch. When the temperature increases beyond a permissible value, the bimetallic snap-action disc lifts the contact plate off from the stationary contacts, as a result of which the switch is opened and the supply to the appliance to be protected is interrupted.

The appliance which is now without power can then cool down again. In this case, the switch which is thermally coupled to the appliance also cools down again, the said switch then automatically closing again.

As a result of the dimensions of the contact plate, the known switch is able to carry much higher high operating currents compared to other temperature-dependent switches in which the operating current of the appliance to be protected flows directly across the bimetallic snap-action disc or a snap-action spring washer associated therewith, and therefore the switch can be used to protect relatively large electrical appliances with a high power consumption level.

As already mentioned, the known switch automatically switches on again after the appliance which is protected by it cools down. While switching behaviour of this kind may well be expedient for protecting, for example, a hairdryer, this is not desirable primarily in applications in which the appliance to be protected must not be automatically switched on again after having been switched off, in order to avoid damage. This is the case, for example, for electric motors which are used as drive assemblies.

DE 198 27 113 C2 therefore proposes a so-called self-holding resistor which is connected electrically parallel to the outer connections. When the switch is open, the self-holding resistor is connected electrically in series to the appliance to be protected, only a harmless residual current now flowing through the said appliance on account of the resistance value of the self-holding resistor. However, this residual current is high enough to heat the self-holding resistor to such an extent that it gives off heat which keeps the bimetallic snap-action disc above its switching temperature.

DE 198 27 113 C2 describes two different ways in which the self-holding resistor can be produced and fitted. In a first embodiment, resistor tracks are provided on the inner surface of the upper part, the said resistor tracks connecting the two stationary contacts to one another and carrying the residual current, which ensures self-holding, when the switch is open. In another embodiment, the upper part is produced from PTC thermistor material, and therefore the upper part itself forms the self-holding resistor.

Although the known switch has proven useful from a technical point of view, problems arise in the event of long-term use, particularly when very high currents are intended to be switched.

In order for two reproducible bearing areas which ensure secure contact and therefore low contact resistance to be provided for the current transfer member, the stationary contacts, that is to say the internal heads of the rivets, have to be symmetrical to the axis of symmetry of the upper part and current transfer member. Furthermore, the said stationary contacts have to be situated in one plane.

In order to achieve this, the heads of the contact rivets which are used in the known switch bear firmly against the upper part on the inside and on the outside. So-called contact brackets are then fixed to the outside of the upper part by way of the outer heads, connection wires being soldered or crimped onto the said contact brackets. This type of contact-making operation leads to secure contact between the current transfer member and the stationary contacts when the contact rivets are symmetrical to the axis of symmetry.

However, for production-related reasons, this symmetrical position is not always ensured. This is the case, for example, in upper parts which are composed of PTC thermistor material.

Within the scope of the present invention, a "PTC thermistor material" is understood to be a current-carrying ceramic material which has a positive temperature coefficient, with the result that the electrical resistance of the said ceramic material increases as the temperature increases. The temperature-dependent change of the electrical resistance value is not linear in this case.

PTC thermistors of this kind are also called PTC resistors. They are produced, for example, from semiconductive, polycrystalline ceramics such as $BaTiO_3$.

In order to produce the PTC upper parts, mixtures of barium and titanium compounds and also other materials, which together exhibit the desired electrical and thermal properties, are compressed in a mould with the desired geometric dimensions and passage openings for the contact rivets, and are then sintered at high temperatures.

In this case, sintering can change the geometry of the upper parts such that the geometric position of the passage openings varies. Both the distance between the passage openings and the distance of the passage openings from the centre of the cover change in an unpredictable manner during sintering.

This leads to the current transfer member not always bearing securely on the stationary contacts, with the result that larger contact resistances than desired are produced.

These relatively large contact resistances lead, in particular with a high current flow, to heating of the contact rivets which expand, particularly in length, in such a way that the mechanical retention of the contact brackets is adversely affected and the contact resistance rises again. This, in turn, leads to further heating as a kind of positive feedback, this further heating further increasing the contact resistance, and so on.

This intrinsic current heating then leads to the switching temperature of the switch changing. Even when the temperature of the monitored appliance is below the response temperature of the switch, the additional intrinsic current heating can lead to the switch undesirably opening.

These problems occur particularly at high currents, for example in three-phase alternating current applications in which very high current flows in the individual phases. In this case, a temperature-dependent switch of the generic type is provided in each phase, said switch disconnecting the phase in the event of an impermissible increase in temperature.

In this case, it is desirable for all three phases to be disconnected simultaneously. However, this requires identical heat coupling for all three switches, it only being possible to achieve this with a great deal of technical outlay, if at all.

Therefore, it is also known to place a switch of the generic type in the star of a three-phase alternating current circuit by two phases being connected to the two outer heads of the contact rivets and the third phase being connected to the lower part which is produced from metal. The current in the third phase then flows through the snap-action disc and the pin, which mechanically connects the snap-action disc and the current transfer member to one another, into the current transfer member.

However, this solution is already unsatisfactory because the current flow through the snap-action disc likewise leads to intrinsic current heating, this likewise having an undesirable influence on the switching behaviour in the above-described sense.

Furthermore, in these designs, such high currents flow through the switch that the problem of lengthening of the contact rivets is even more pronounced.

In this connection it is known from U.S. Pat. No. 4,555,686 A to provide a temperature-dependent switch with a heater plate having arranged thereon three moveable contacts, each of which cooperates with a stationary contact. Said heater plate is being moved by a bimetallic spring, whereby constructional measures avoid that the heater plate can be rotated in its circumferential direction relative to the stationary contacts.

This switch is associated with the disadvantage that it is of complex design and that the permanent development of heat inside the switch makes it unsuited for guiding high currents.

SUMMARY OF THE INVENTION

One object of the present invention is to improve the switch mentioned at the outset in a structural simple manner such that it can also carry and switch high current without its response temperature being impermissibly shifted as a result.

According to the invention, this and other objects are achieved in the case of the switch mentioned at the outset in that a third bearing area for the current transfer member is provided on the inner surface, and that the current transfer member is an approximately round contact plate which is provided, on its surface which faces the stationary contacts, with a contact area which is closed in the circumferential direction around an axis of symmetry of the switch.

According to one object, the contact plate is connected to the bimetallic snap-action disc and possibly the snap-action spring washer by a pin-like rivet.

When an approximately round contact plate is used, this firstly allows, in a particularly simple manner, the contact area which is closed in the circumferential direction and with which the stationary contacts come into contact in different regions with any desired orientation of the contact plate. In this case, the round contact plate is supported in a particularly secure manner by the three bearing points with any circumferential orientation, and therefore said round contact plate cannot "tilt" when it is in contact with the stationary contacts. Therefore, it is not necessary to pay any attention to the circumferential orientation of the current transfer member in the switch when assembling the new switch.

Within the scope of the present invention, a bearing area is understood to mean a flat or punctiform bearing region for the current transfer member, which bearing region is provided on the inner surface of the upper part and with which bearing region the said current transfer member comes into contact when the switch is closed. The two stationary contacts form two such bearing areas.

On account of the third bearing area, the current transfer member is now held in contact with the stationary contacts in the manner of a three-point support, so that said current transfer member is in stable contact and cannot tilt. The third bearing area is provided only for the purpose of additional support, that is to say is not contacted-through to the outside.

The inventor of the present application has identified that a further bearing area which does not have an electrical function provides advantages when high currents are intended to be switched, in spite of the higher production costs which are associated with said further bearing area. Stable lying of the current transfer member on the stationary contacts now ensures low contact resistances irrespective of whether the stationary contacts are exactly symmetrical to the axis of symmetry of the switch.

In other words, when the position of the stationary contacts differs from the ideal geometric position on account of production technology or production tolerances or even due to the effects of the intrinsic current heating, this does—owing to the third bearing area—not lead to the negative effects described in detail at the outset.

This leads to the switching behaviour of a switch which is provided with a third bearing area being independent of current and being reproducible even at high currents.

In this case, the snap-action disc can be a bimetallic snap-action disc which provides the closing pressure and the temperature-dependent opening movement. However, the closing pressure can also be applied solely or additionally by a snap-action spring washer, while a bimetallic snap-action disc is provided which provides only the opening movement or else also contributes to the contact pressure in its low-temperature position.

It is therefore preferred when the snap-action disc is a bimetallic snap-action disc which is mechanically connected to the current transfer member and presses the said current transfer member against the stationary contacts below its switching temperature and lifts the said current transfer member off from said stationary contacts above its switching temperature.

Secondly, it is preferred when the snap-action disc is a snap-action spring washer which prestresses the current transfer member such that it makes contact with the stationary contacts, and a bimetallic snap-action disc is provided, this bimetallic snap-action disc lifting the current transfer member off from the stationary contacts above its switching temperature, with the snap-action spring washer further preferably being arranged between the current transfer member and the bimetallic snap-action disc.

While it is entirely adequate when only a bimetallic snap-action disc which creates the contact pressure and provides for temperature-dependent opening is provided, a snap-action spring washer, which produces the contact pressure in addition to the bimetallic snap-action disc or on its own, can relieve the mechanical loading on the bimetallic snap-action disc in its low-temperature position, this contributing to greater long-term stability of the switching behaviour of the said bimetallic snap-action disc.

On the one hand side, it preferred when two contact rivets pass through the upper part, the internal heads of said contact rivets serving as stationary contacts and the external sections of said contact rivets serving as outer connections. In addition to the two stationary contacts, the third bearing point is also present, and therefore the current transfer member securely bears on three points.

This switch can now be used to carry high currents in a phase of a three-phase alternating current circuit. The contact resistance between the two stationary contacts and the current transfer member now remains constantly low, and therefore the problems with the lengthening of the rivet described in the introductory part can be avoided or at least reduced to such an extent that the response temperature is not influenced in an undesirable manner.

When the upper part is produced from PTC thermistor material, the switch is additionally equipped with a self-holding function.

According to another object, a third stationary contact is provided on the inner surface, said third stationary contact being connected to an associated outer connection and the third bearing area being provided on the said third stationary contact, with three contact rivets preferably passing through the upper part, the internal heads of said contact rivets serving as stationary contacts and the external sections of the said contact rivets serving as outer connections.

This creates a true three-phase alternating current switch with three simultaneously operated pairs of switching contacts. This switch first of all has precisely the same advantages in respect of abutment of the contact plate as the above-described switch. The only difference now is that the third bearing area is electrically active and plated-through to the outside.

This switch can therefore be used in the star point of a three-phase alternating current circuit where it is connected to all three phases.

It is particularly advantageous here that no current is carried by the snap-action disc and that low contact resistances are ensured. This leads to the new switch also having a stable response temperature in the event of high switching currents.

It is also ensured that all three switching contacts open simultaneously.

The upper part is then produced from insulating material.

It is generally preferred when the bearing areas are arranged symmetrically to an axis of symmetry of the switch.

It is advantageous here that the secure mechanical contact of the current transfer member, in particular of the round contact plate, is realized in a particularly reliable manner.

According to a still further object, at least one outer connection has a contact bracket which is held on a shank of the contact rivet by means of forces which are directed at least partially transverse to the longitudinal axis of the shank, with the contact bracket preferably having a hole which is shrink-fitted onto the shank.

In the case of these measures, it is advantageous that the contact bracket is held on the contact rivet in a technically simple manner, with temperature effects which lead to lengthening of the contact rivet at the same time being prevented from increasing the contact resistances.

Shrink-fitting is performed, for example, by the shank being cooled down to a great extent, so that it shrinks and can be inserted into the hole in the contact bracket. If the contact bracket heats up again, a press-fit is produced between the shank and the contact bracket, this press-fit not becoming looser again, but rather becoming more secure, when the shank is heated further.

Consequently, this measure leads to the unavoidable intrinsic current heating not having any effect on the contact resistances and therefore on the switching behaviour in the case of switches which carry high currents.

Further advantages can be found in the description and the appended drawing.

It goes without saying that the features which are mentioned above and those which are still to be explained below can be used not only in the respectively given combination, but also in other combinations or on their own, without departing from the scope of the present invention.

BRIEF DESCRIPTION OF THE DRAWINGS

Embodiments of the invention are illustrated in the appended drawing and will be explained in greater detail in the following description. In the drawing:

FIG. 7 shows a schematic, sectioned side view of one of the contact rivets of the switch from FIGS. 1 to 6 with a connection bracket shrink-fitted on.

DESCRIPTION OF PREFERRED EMBODIMENTS

Figure 1:
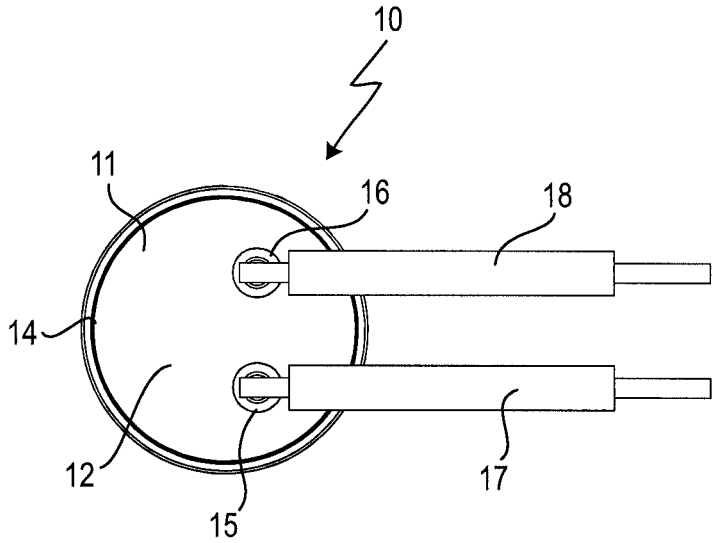
FIG. 1 shows a plan view of a first embodiment of the new switch.

In FIG. 1, 10 designates a temperature-dependent switch which comprises a temperature-dependent switching mechanism which is accommodated in a housing 11. The housing 11 has an upper part 12 which closes off a lower part, an edge 14 of said lower part fixing the upper part 12 to the lower part.

Two outer connections 15, 16 are arranged on the upper part 12, two connection wires 17, 18 being soldered onto the outer connections and the switch 10 being connected in series to an appliance to be protected by means of said connection wires in the power supply circuit of the said appliance.

Figure 2:
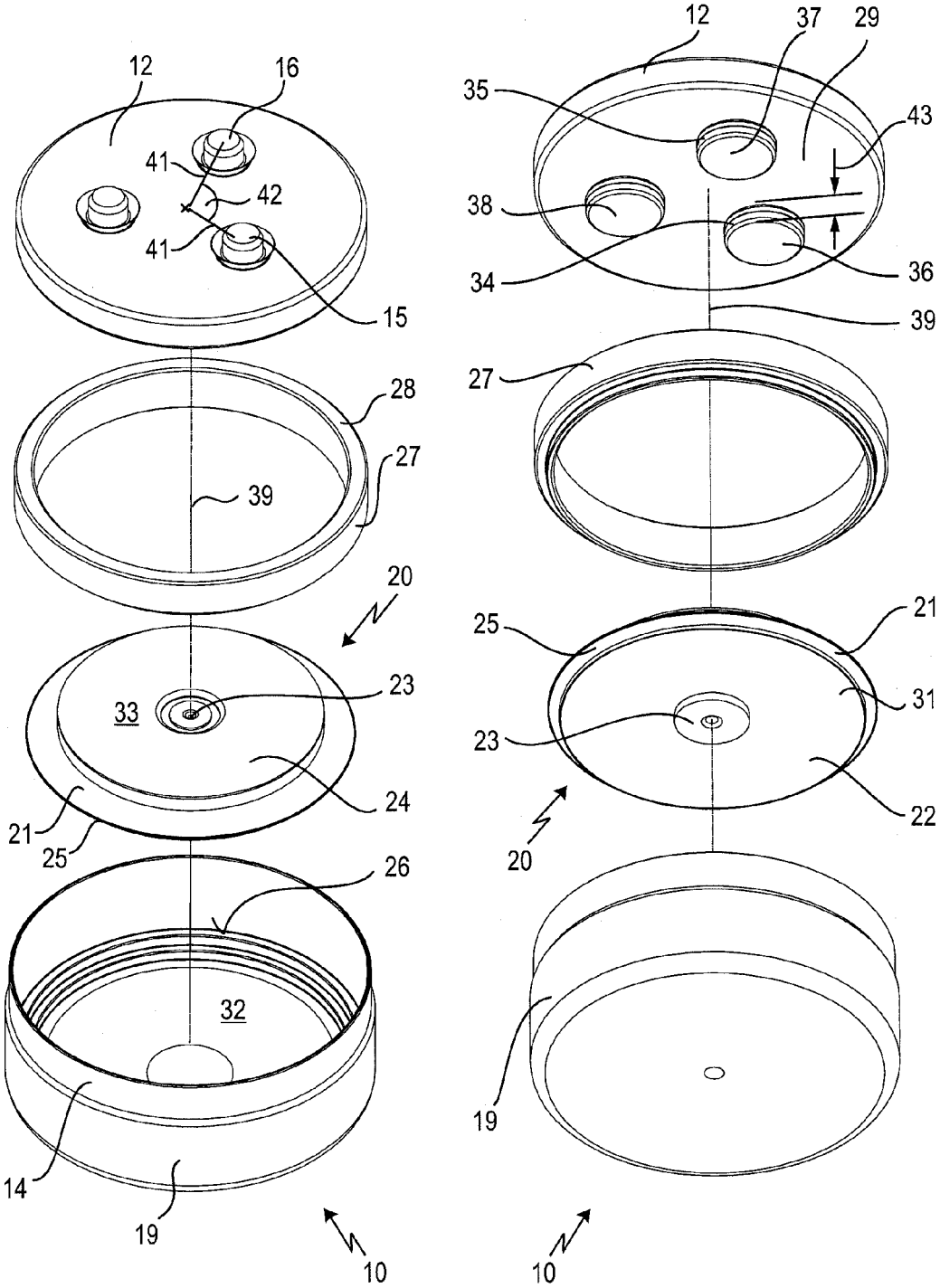
FIG. 2 shows an exploded illustration of the switch from FIG. 1, in a view from above on the left-hand side of the illustration and in a view from below on the right-hand side of the illustration.

FIG. 2 shows the switch 10 from FIG. 1 in a perspective exploded illustration, in a view from above on the left-hand side of FIG. 2 and in a view from below on the right-hand side of FIG. 2.

A cup-like lower part 19 with edge 14 is shown at the bottom of FIG. 2, the temperature-dependent switching mechanism 20 being inserted into the said cup-like lower part from above.

The switching mechanism 20 comprises a snap-action spring washer 21 and a bimetallic snap-action disc 22, a pin-like rivet 23 passing through the centre of said bimetallic snap-action disc and the snap-action spring washer 21, said bimetallic snap-action disc and snap-action spring washer being mechanically connected by said pin-like rivet to a current transfer member provided in the form of a contact plate 24.

When the switching mechanism 20 is inserted into the lower part 19, the edge 25 of the snap-action spring washer 21 comes into contact with a circumferential shoulder 26 inside the lower part 19. A spacer ring 27 is mounted on the edge 25, the upper part 12, by way of its inner surface 29, coming to rest on the upwardly facing end surface 28 of said spacer ring. The upper part 12 is then fixed to the lower part 19 by the edge 14 being beaded, and the housing 11 is closed.

In this way, the edge 25 of the snap-action spring washer 21 is clamped between the shoulder 26 and spacer ring 27 while the bimetallic snap-action disc 22, by way of its edge 31, is supported inside the housing on a base 32 of the lower part 19.

The round, in the present case circular, contact plate 24 has, in the direction of the upper part 12, an electrically conductive contact area 33 which extends in the circumferential direction an axis of symmetry 39 and which interacts with two stationary contacts 34, 35 which are arranged on the inner surface 29 of the upper part 12.

The stationary contacts 34, 35 are in the form of inner heads of contact rivets which pass through the upper part 12 and, by way of their outer sections, form the outer connections 16 and 15, respectively.

The stationary contacts 34, 35 form, by way of their end surfaces 36, 37, bearing areas for the contact plate 24. A third bearing area 38 for the contact plate 24 is provided on the inner surface 29, said third bearing area not having an associated outer connection but rather serving to stabilize the contact plate 24 when it is pressed by the snap-action spring washer 22 against the stationary contacts 34, 35 which are then electrically short-circuited by means of the contact area 29, so that the switch 10 is closed.

The three bearing areas 36, 37, 38 form a kind of three-point bearing for the contact plate 24, so that said contact plate is held in a position, in which it closes the switch, in a mechanically stable manner and cannot tilt. This ensures that the switch 10 is securely closed and, owing to the mechanically reliable lying of the contact area 33 on the stationary contacts 34, 35, the contact resistance there is always at a constantly low level.

Owing to this three-point bearing, the geometric position of the stationary contacts 34, 35 is considerably less critical for the switching behaviour of the new switch than is the case in the known switches with only two bearing areas.

The three bearing areas 36, 37, 38 are approximately symmetrical to the axis of symmetry 39 of the switch. This means that they are at approximately the same radial distance 41 from the axis 39 of symmetry and are at an angle 42 of in each case 120° to one another in the circumferential direction about the axis 39 of symmetry.

If the position of the bearing areas now differs from the ideal geometric arrangement shown in FIG. 2 due to production technology or due to production tolerances, the secure mechanical contact of the contact plate 24 on the stationary contacts 34, 35 is not influenced as a result.

The same applies when, owing to a high current flow, the contact rivets are heated and there is an accompanying certain change in the height 43 of the bearing areas 36, 37, 38 over the inner surface 29.

The upper part 12 can be produced from PTC thermistor material, and therefore the switch has a self-holding function because, when the switch 10 is open, a residual current flows through the upper part 12 and heats the said upper part to such an extent that a temperature which holds the switch 10 open is maintained in said switch.

Figure 3:
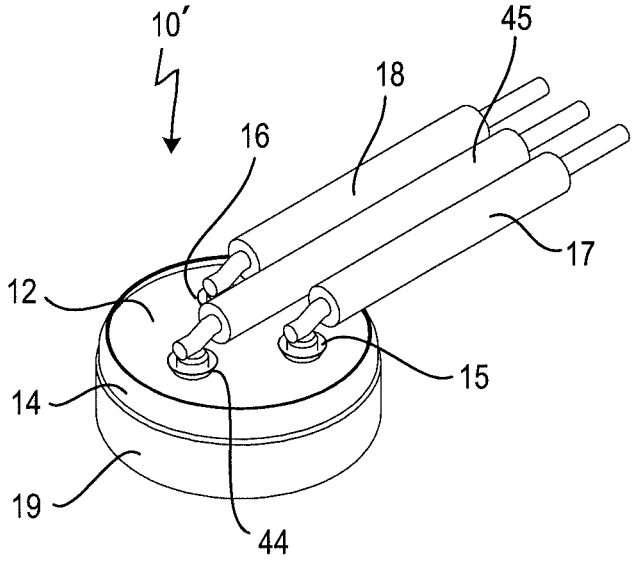
FIG. 3 shows a perspective plan view of a second embodiment of the new switch.

The switch 10 can now also be designed such that the third bearing area 38 is also in the form of a stationary contact and is connected to a third outer connection 44 by means of a contact rivet to the outside, a third connection wire 45 being connected to said outer connection, as shown in the perspective plan view of FIG. 3 for a three-phase alternating current switch 10'.

Figure 4:
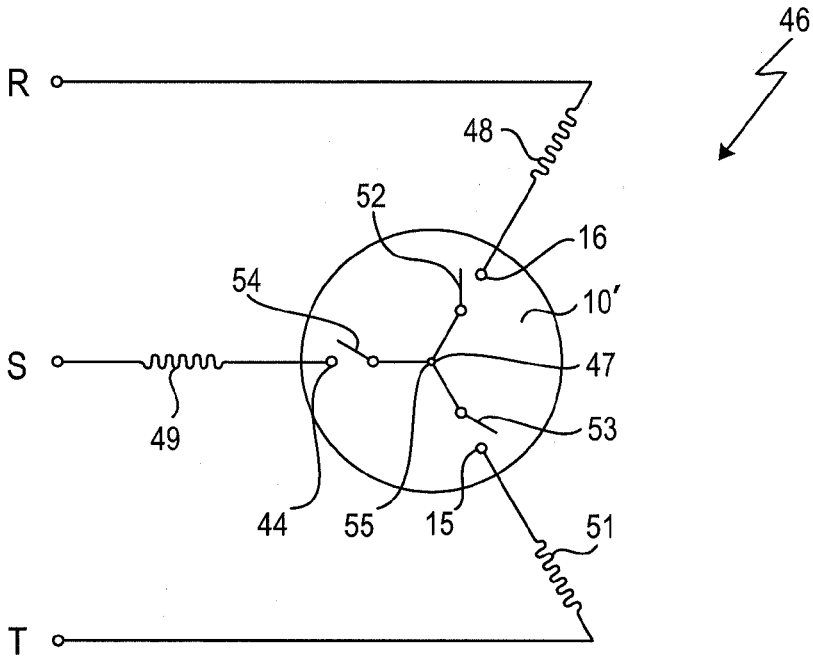
FIG. 4 shows a circuit diagram which shows the arrangement of the switch from FIG. 3 as a star point of a three-phase alternating current circuit.

The switch 10' can then be used to simultaneously switch three phases R, S, T of a three-phase alternating current circuit 46, as shown in FIG. 4. To this end, the switch 10' is connected as a star point 47 of the three-phase alternating current circuit 46 such that the phase R is connected to the outer connection 16 via a load winding 48, the phase S is connected to the outer connection 15 via a load winding 49, and the phase T is connected to the outer connection 44 via a load winding 51.

When the switch 10' is closed, all three phases R, S and T are connected to one another by means of the contact plate 24. The three switch symbols 52, 53, 54 shown in FIG. 4 represent the interaction of the bearing areas 36, 37, 38 with the contact plate 24 which is symbolized by a node 55.

If the temperature of the load symbolized by the load windings 48, 49, 51 now increases beyond the response temperature of the switch 10', the contact plate 24 lifts off from the bearing areas 36, 37, 38, and therefore all three phases R, S and T are disconnected at the same time.

The upper part 12 is now produced from insulating material, while the lower part 19 can be composed of an electrically conductive material in order to achieve good thermal coupling to the loads 48, 49, 51.

The advantages achieved by the three-point support are produced for the three-phase alternating current switch 10' from FIGS. 3 and 4 in the same way as in the case of the switch 10 from FIGS. 1 and 2.

Figure 6:
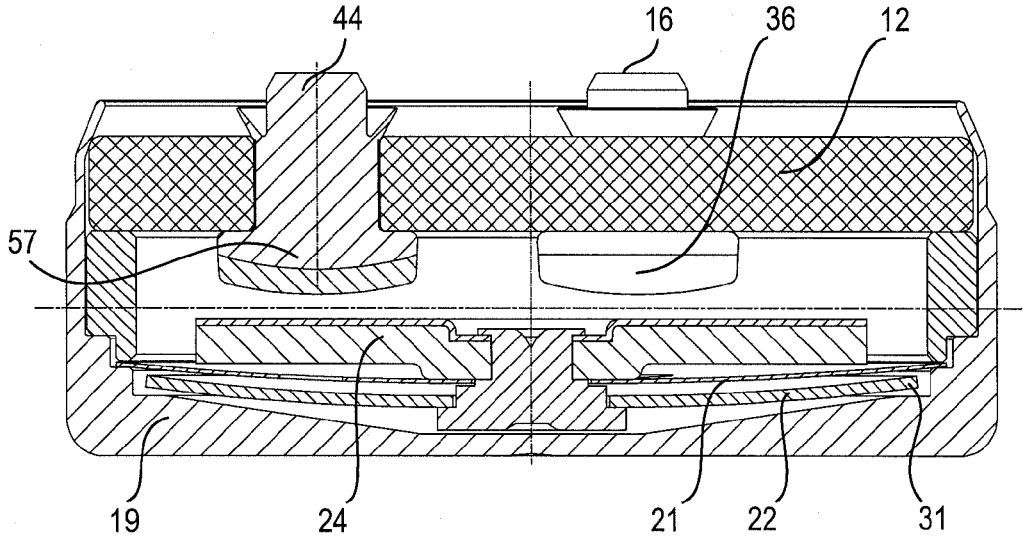
FIG. 6 shows an illustration similar to that in FIG. 5, but with the switching mechanism open.
Figure 5:
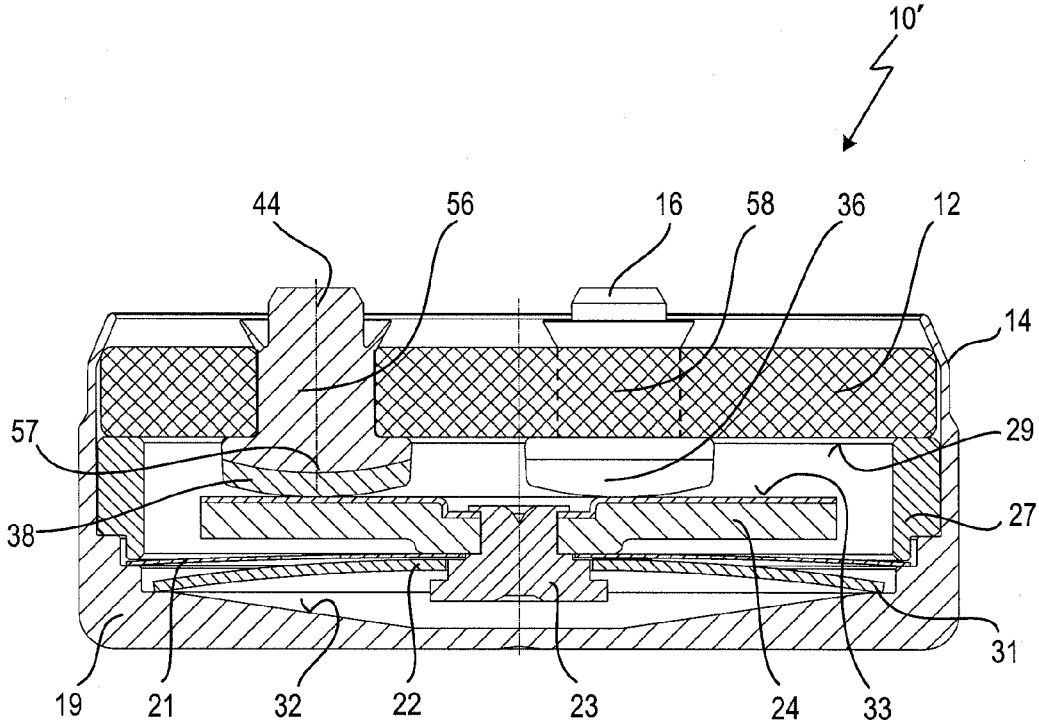
FIG. 5 shows a schematic, sectioned side view of the switch from FIG. 3 with the switching mechanism closed.

FIGS. 5 and 6 show the switch 10' from FIGS. 3 and 4 in a schematic, sectioned side view. The switch 10' is illustrated closed in FIG. 5 and open in FIG. 6.

The section line in FIGS. 5 and 6 passes through the outer connection 44, and therefore the associated contact rivet 56 with the inner head, which is in the form of a stationary contact 57 and on which the bearing area 38 is formed, can be seen. The outer connection 16 and the associated stationary contact 36 can also be seen.

The stationary contact 36 is, like the stationary contact 35 which cannot be seen, also in the form of an inner head of a contact rivet 58.

In the switching position shown in FIG. 5, the snap-action spring washer 21 and the bimetallic snap-action disc 22 press the contact plate 24 against the stationary contacts 35, 36 and 57 which are therefore electrically connected to one another by means of the contact area 33; the switch 10' is closed.

If the temperature of the bimetallic snap-action disc 22 increases beyond its response temperature, it snaps from the convex shape shown in FIG. 5 to the concave shape shown in FIG. 6 and in the process is supported by way of its edge 31 on the snap-action spring washer 21 and pulls the contact plate 24 away from the stationary contacts 35, 36, 57 against the force of the snap-action spring washer 21; the switch 10' is now open.

Figure 7:
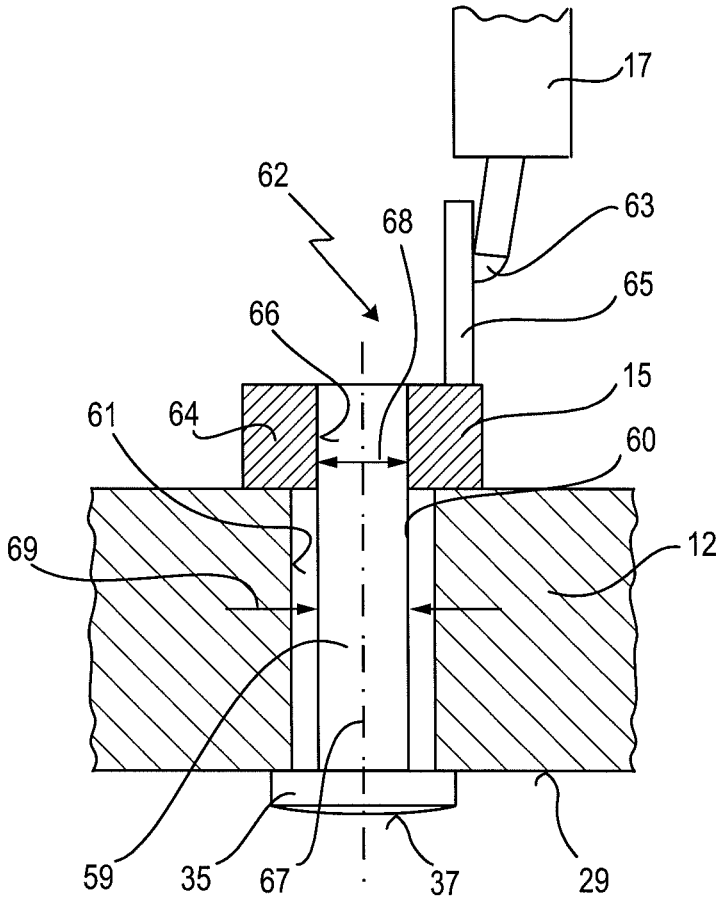
Figure 8:
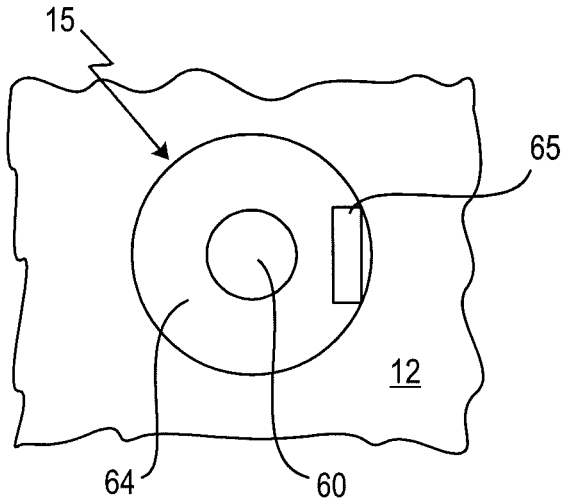
FIG. 8 shows a plan view of the contact bracket from FIG. 7.

FIG. 7 shows a schematic longitudinal section in the region of the outer connection 15 and stationary contact 35 which is in the form of an inner head of a contact rivet 59 and makes contact with the inner surface 29 of the upper part 12. FIG. 8 shows a plan view of the upper part 12 in the region of the outer connection 15.

The contact rivet 59 extends by way of its shank 60, through a hole 61 in the upper part 12, to the outside where the connection 15 is arranged. Whereas the outer connections 15, 16, 44 are illustrated as outer heads of the contact rivets 56, 58, 59, the connection wires 17, 18, 45 being directly soldered onto the said outer heads, in FIGS. 1, 2, 3, 5 and 6, in FIG. 7 a contact bracket 62 is used, this contact bracket 62 being attached to that section of the contact rivet 59 which projects upwards out of the upper part 12, and contact bracket 62 being soldered to the connection wire at 63.

The contact bracket 62 has a cylindrical body 64 on which an upwardly projecting connection lug 65 is provided, the connection wire 17 being soldered to said connection lug.

A hole 66 is provided in body 64, said hole being shrink-fitted onto the shank 60, and therefore the body 64 being seated firmly on the shank 60 and being held on the shank 60 by forces transverse to the longitudinal direction 67 of said shank.

When the contact rivet 59 is now heated owing to high current flow, it expands, this leading to the body 64 being held even more securely on the shank 60. This applies to a material selection in the case of which the inside diameter 68 of the hole 66 is not increased to more than the outside diameter 69 of the shank 60 in the event of an increase in temperature. In general, the inside diameter 68 is even reduced.

It is possible for the shank 60 to also lengthen, so that the contact rivet 59 moves slightly in the direction of the longitudinal axis 67. However, this does not lead to an increase in the contact resistance between the stationary contact 35 and the outer connection 15, as is the case in the riveted contact brackets known from the prior art.

Specifically, in the case of the contact bracket 62, a negligible pressure or else slack in the direction of the longitudinal axis 67 does not lead to the hold of the outer connection 15 on the contact rivet 59 loosening since, on account of shrink-fitting, it is at least also held by forces transverse to the longitudinal direction 67 which become even stronger as the temperature increases.

Even a possibly little slack in the direction of the longitudinal axis 67 does not lead to impaired contact of the contact plate 24 or to an increased contact resistance between the contact area 29 and bearing areas 36, 37, 38 because, in the manner described above, the three-point support of the contact plate 24 always provides for secure and reproducible mechanical contact.

The contact bracket 62 can be used both in the switch 10 and in the switch 10'. It provides advantages in applications where high currents which unavoidably lead to intrinsic heating of the contact rivet 56, 58, 59 are switched.

What is claimed is:

1. A temperature-dependent switch including a temperature-dependent switching mechanism and two outer connections, said switch having an axis of symmetry, said temperature-dependent switching mechanism comprising a snap-action disc and a current transfer member arranged at the snap-action disc, a housing which accommodates the switching mechanism and comprises a lower part and an upper part having an inner surface, two stationary contacts being provided on said inner surface, each stationary contact having a bearing area for said current transfer member and being connected to an associated one of said two outer connections, a third bearing area for the current transfer member being provided on said inner surface, the snap-action disc pressing the current transfer member, in a temperature-dependent manner, against said three bearing areas, and the current transfer member comprising a round contact plate having a surface facing the stationary contacts and a contact area on the surface facing the stationary contacts, said contact area being closed in itself in a circumferential direction around said axis of symmetry of the switch.

2. The switch of claim 1, wherein the snap-action disc is a bimetallic snap-action disc which is mechanically connected to the current transfer member and presses said current transfer member against the stationary contacts and the third bearing area when below its switching temperature, and lifts said current transfer member off from said stationary contacts when above its switching temperature.

3. The switch of claim 1, wherein the snap-action disc is a snap-action spring washer which pre-stresses the current transfer member such that it makes contact with the stationary contacts and the third bearing area, whereby a bimetallic snap-action disc is provided, the bimetallic snap-action disc lifting the current transfer member off from the stationary contacts when above its switching temperature.

4. The switch of claim 1, wherein two contact rivets pass through the upper part, internal heads of said contact rivets serving as stationary contacts and external sections of said contact rivets serving as outer connections.

5. The switch of claim 4, wherein the upper part is produced from PTC thermistor material.

6. The switch of claim 4, wherein the upper part is produced from insulating material.

7. The switch of claim 1, wherein the three bearing areas are arranged symmetrically to said axis of symmetry.

8. The switch of claim 4, wherein at least one outer connection comprises a contact bracket which is held on a shank of the associated contact rivet by means of forces which are directed at least partially transverse to a longitudinal axis of the shank.

9. The switch of claim 8, wherein the contact bracket comprises a hole which is shrink-fitted onto the shank.

10. The switch of claim 1, wherein a third outer connection is provided and three contact rivets pass through the upper part, an internal head of each contact rivet serving as stationary contact and an external section of each contact rivet serving as outer connection.

11. A temperature-dependent switch including a temperature-dependent switching mechanism and two outer connections, said switch having an axis of symmetry, said temperature-dependent switching mechanism comprising a snap-action disc and a current transfer member arranged at the snap-action disc, a housing which accommodates the switching mechanism and comprises a lower part and an upper part having an outer surface and an inner surface, two contact rivets passing through the upper part, an internal head of each contact rivet lying at said inner surface and serving as one of two stationary contacts, and an external section of each contact rivet lying at said outer surface and serving as one of said two outer connections, each internal head of said two contact rivets providing a bearing area for said current transfer member, a third bearing area for said current transfer member being provided on said inner surface, the current transfer member comprising a round contact plate having a surface facing the stationary contacts and a contact area on the surface facing the stationary contacts, said contact area being closed in itself in a circumferential direction around said axis of symmetry of the switch, the snap-action disc pressing the current transfer member, in a temperature-dependent manner, against said three bearing areas.

* * * * *